US007552667B2

(12) United States Patent
Chan

(10) Patent No.: US 7,552,667 B2
(45) Date of Patent: Jun. 30, 2009

(54) PAPER CUTTING APPARATUS

(76) Inventor: Stephen Kwok Ki Chan, Room 1606-9, 16th Floor, Tower A, Regent Centre, 63 Wo Yi Hop Road, Kwai Chung, New Territories (HK)

( * ) Notice: Subject to any disclaimer, the term of this patent is extended or adjusted under 35 U.S.C. 154(b) by 0 days.

(21) Appl. No.: 11/494,520

(22) Filed: Jul. 28, 2006

(65) Prior Publication Data

US 2007/0028738 A1 Feb. 8, 2007

Related U.S. Application Data

(63) Continuation-in-part of application No. 11/194,451, filed on Aug. 2, 2005, now abandoned.

(51) Int. Cl.
*B26D 5/08* (2006.01)

(52) U.S. Cl. ..... 83/614; 83/485; 83/455

(58) Field of Classification Search ..... 83/455, 83/563, 614, 628, 397–398, 478, 485; 30/162, 30/292–294, 314–317, 319, 388
See application file for complete search history.

(56) References Cited

U.S. PATENT DOCUMENTS 4,798,112 A 1/1989 Kozyrski et al.
5,069,097 A * 12/1991 Mori ..... 83/56
5,237,900 A * 8/1993 Supe-Dienes et al. ..... 83/563
5,243,890 A * 9/1993 Ober ..... 83/471.2
5,322,001 A * 6/1994 Boda ..... 83/485
5,996,459 A 12/1999 Cornell et al.
6,098,515 A * 8/2000 Daley, Jr. ..... 83/485
6,438,850 B2 8/2002 Young et al.
6,460,443 B1 * 10/2002 Hsiao ..... 83/614
6,776,077 B1 8/2004 Chen
6,782,785 B2 8/2004 Mori et al.
6,931,974 B2 * 8/2005 Tseng ..... 83/699.11
7,040,208 B2 * 5/2006 Mori et al. ..... 83/563
2004/0098867 A1 * 5/2004 Tseng ..... 30/290
2005/0223863 A1 * 10/2005 Volfson et al. ..... 83/485

FOREIGN PATENT DOCUMENTS

EP 976 511 2/2000
EP 1 232 841 8/2002
JP 9-168996 6/1997

* cited by examiner

*Primary Examiner*—Jason Daniel Prone
*Assistant Examiner*—Joseph DeFrank
(74) *Attorney, Agent, or Firm*—Leydig, Voit & Mayer, Ltd.

(57) ABSTRACT

A cutting apparatus for cutting sheets of paper, plastic, or the like, has a carriage for sliding along a rail, a cassette holder engageable with the carriage, and a cassette encasing a cutting blade and co-operable with the carriage, when held by the cassette holder, to expose a cutting edge of the cutting blade during engagement of the cassette holder with the carriage. The cassette, which may be separate from the carriage, has a rotary cutting blade and a cover covering the blade.

20 Claims, 11 Drawing Sheets

PAPER CUTTING APPARATUS

BACKGROUND OF THE INVENTION

More particularly, but not exclusively, the invention relates to cutting apparatus for use in rotary paper trimmers of the type that generally comprises a board, a rail on the board under which a sheet of paper may be placed on the board, and a rotary cutting blade slidable along the rail to cut the paper sheet.

The cutting blade can be changed, and replacement or interchangeable blades may be purchased separately or come with a kit of blades for different cutting patterns. Replacement of the blade is a dangerous exercise, which can result in finger cut injury, because the sharp cutting edge extends 360° around the blade.

The invention also relates to a cutter cassette which has a safety cover that protects the user from the cutting blade prior to use.

The invention seeks to obviate or at least alleviate such a problem or shortcoming by providing a new or otherwise improved cutter cassette and cutting apparatus using the same.

SUMMARY OF THE INVENTION

According to the invention, there are provided cutting apparatus for cutting sheets of paper, plastic or the like, comprising:

a carriage for sliding along a rail;

a cassette holder engageable with the carriage; and a cassette encasing a cutting blade and co-operable with the carriage when held by the cassette holder to expose a cutting edge of the cutting blade during closing engagement of the cassette holder with the carriage.

Preferably, the cassette includes a cover covering the entire cutting blade, the cover being resiliently biased to conceal the cutting edge.

Preferably, the cassette includes a cover covering the entire cutting blade, and the cover is movable relative to the cutting blade and has a part engageable with a part of the carriage upon said closing engagement to cause movement of the cover to expose the cutting edge of the cutting blade.

More preferably, the part of the carriage comprises a ramp inclined to the direction in which said closing engagement occurs, for engagement with the part of the cover to move the cover in a different direction.

In a preferred embodiment, the cover is slidable relative to the cutting blade in a direction parallel to the cutting blade.

More preferably, the cover comprises first and second cover members covering opposite sides of the cutting blade.

Further more preferably, the first and second cover members are individually slidable, and the first cover member has said part engageable with said part of the carriage upon said closing engagement to cause movement of the first cover member to expose the corresponding side of the cutting edge of the cutting blade.

Yet further more preferably, the cutting apparatus include an operator on one of the carriage and the cassette holder, which is arranged to move the second cover member to expose the corresponding side of the cutting edge of the cutting blade, subsequent to said closing engagement.

Yet further more preferably, the operator is provided at the cassette holder.

Yet further more preferably, the operator has a part engageable with a part of the second cover member to move the second cover member, the two parts being a cam and a cam follower.

Even yet further more preferably, the part of the operator is engageable indirectly with the part of the second cover member, and comprises a cam for turning to move the second cover member.

Yet further more preferably, the operator incorporates a retainer and is arranged to also move the retainer into interlocking with the other of the carriage and the cassette holder, thereby retaining the cassette holder with the carriage.

Even yet further more preferably, the operator is provided at the cassette holder, with the retainer adapted to engage the second cover member for holding the cassette and moving the second cover member.

It is preferred that the cassette includes a support member supporting the cutting blade, and further includes a resilient latch provided between the support member and the cover blocking against said movement of the cover relative to the cutting blade, the latch being releasable by a part of the cassette holder upon the cassette being held by the cassette holder.

It is further preferred that the cover is resiliently biased by a spring to conceal the cutting edge of the cutting blade, and the latch is provided at one of the support member and the cover and is re-engageable with an adjacent part of the other of the support member and the cover that the latch previously engages, upon removal of the cassette from the cassette holder and return of the cover by the spring.

It is further preferred that the cover comprises first and second cover members covering opposite sides of the cutting blade, each cover member being latched by a respective said latch against individual movement relative to the cutting blade, and the cassette holder has two said parts for releasing the latches respectively.

In one example, the latch for the first cover member is a resiliently biased latch provided at the first cover member.

In another example, the latch for the second cover member is a resiliently deformable latch provided at the support member.

In a preferred embodiment, the cutting blade comprises a rotary cutting disc supported centrally on an axle for rotation thereabout.

More preferably, the carriage and the cassette holder have respective supports for supporting opposite ends of the axle when the cassette is held by the cassette holder and the cassette holder engages with the carriage.

The invention also provides a cutter cassette for use in a rotary paper trimmer having a carriage for carrying the cassette to move along a path, comprising a rotary cutting blade and a cover covering the cutting blade, being co-operable with said carriage to expose a cutting edge of the cutting blade during engagement of the cassette with said carriage.

More preferably, the cover encases the entire cutting blade and is resiliently biased to conceal the cutting edge.

More preferably, the cover encases the entire cutting blade and is movable relative to the cutting blade and has a part engageable with a part of said carriage upon said engagement to cause movement of the cover to expose the cutting edge of the cutting blade.

In a preferred embodiment, the cover is slidable relative to the cutting blade in a direction parallel to the cutting blade.

More preferably, the cover comprises first and second cover members covering opposite sides of the cutting blade.

Further more preferably, the first and second cover members are individually slidable, and the first cover member has said part engageable with said part of the carriage upon said engagement to cause movement of the first cover member to expose the corresponding side of the cutting edge of the cutting blade.

Yet further more preferably, the second cover member has a cam follower for movement by a cam at said carriage to expose the corresponding side of the cutting edge of the cutting blade, subsequent to said engagement.

It is preferred that the cutting cassette includes a support member supporting the cutting blade, and further includes a resilient latch provided between the support member and the cover blocking against said movement of the cover relative to the cutting blade, the latch being releasable by a part of a cassette holder co-operable with said carriage upon the cassette being held by said cassette holder.

It is further preferred that the cover is resiliently biased by a spring to conceal the cutting edge of the cutting blade, and the latch is provided at one of the support member and the cover and is re-engageable with an adjacent part of the other of the support member and the cover that the latch previously engages, upon removal of the cassette from said cassette holder and return of the cover by the spring.

It is further preferred that the cover comprises first and second cover members covering opposite sides of the cutting blade, each cover member being latched by a respective said latch against individual movement relative to the cutting blade, the latches being releasable by respective parts of said cassette holder.

In one example, the latch for the first cover member is a resiliently biased latch provided at the first cover member.

In another example, the latch for the second cover member is a resiliently deformable latch provided at the support member.

In a preferred embodiment, the cutting blade comprises a rotary cutting disc supported centrally on an axle for rotation thereabout.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
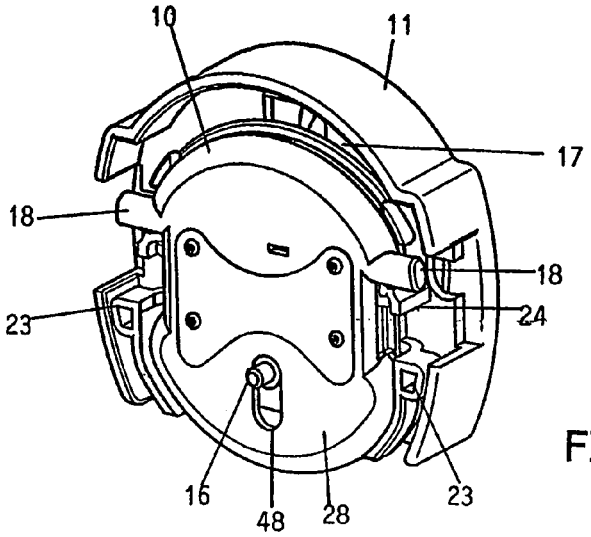
FIG. 1 is a rear perspective view of a cutter cassette held in a cassette holder of an embodiment of cutting apparatus in accordance with the invention.

Referring to the drawings, there are shown cutting apparatus for cutting sheets of paper, plastic or the like embodying the invention, which comprise a carriage 12, a cassette (or cartridge) holder 11 engageable with the carriage 12, and a cutter cassette (or cartridge) 10. The cassette 10 encases a cutting blade in the form of a rotary cutting disc 14 supported centrally on an axle 16 for free rotation thereabout. Apart from the cutting disc 14 that is made of stainless steel, most of the other components are moulded from plastics material.

Figure 2:
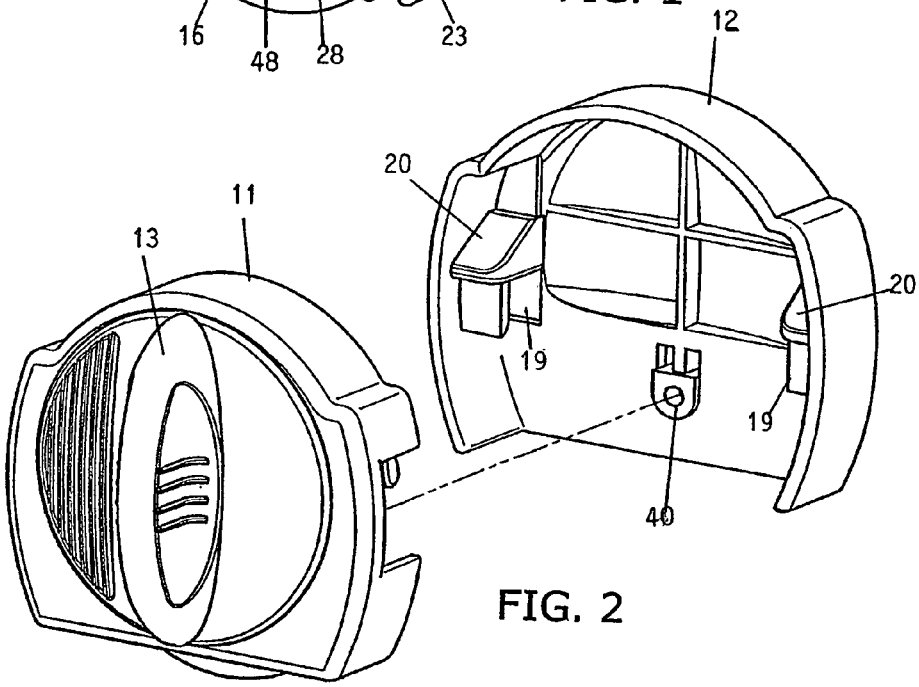
FIG. 2 is a front perspective view of the cassette holder with cassette of FIG. 1, showing also a carriage of the cutting apparatus.
Figure 35:
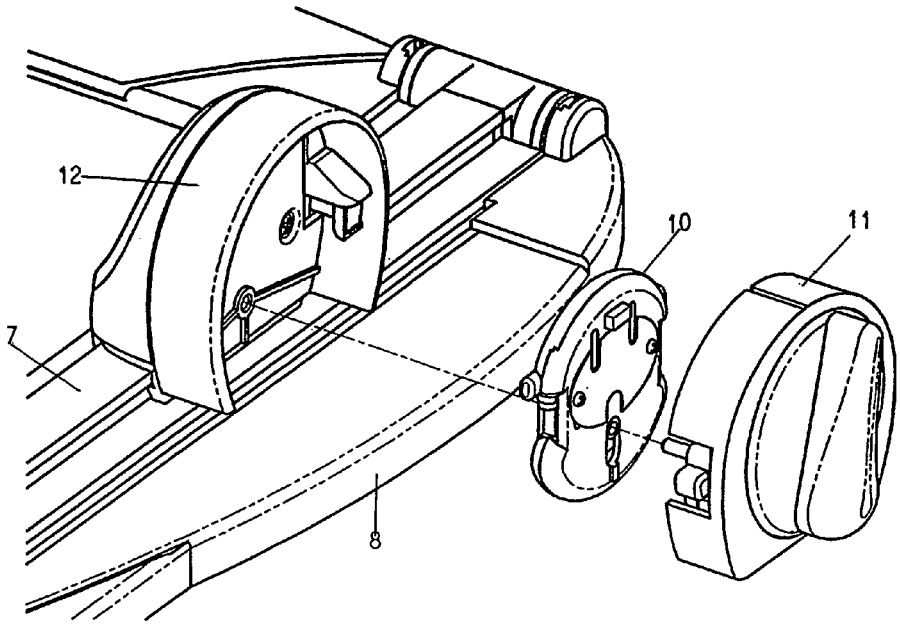
FIG. 35 is a fragmentary perspective view of a rotary paper trimmer that incorporates the subject cutting apparatus.
Figure 36:
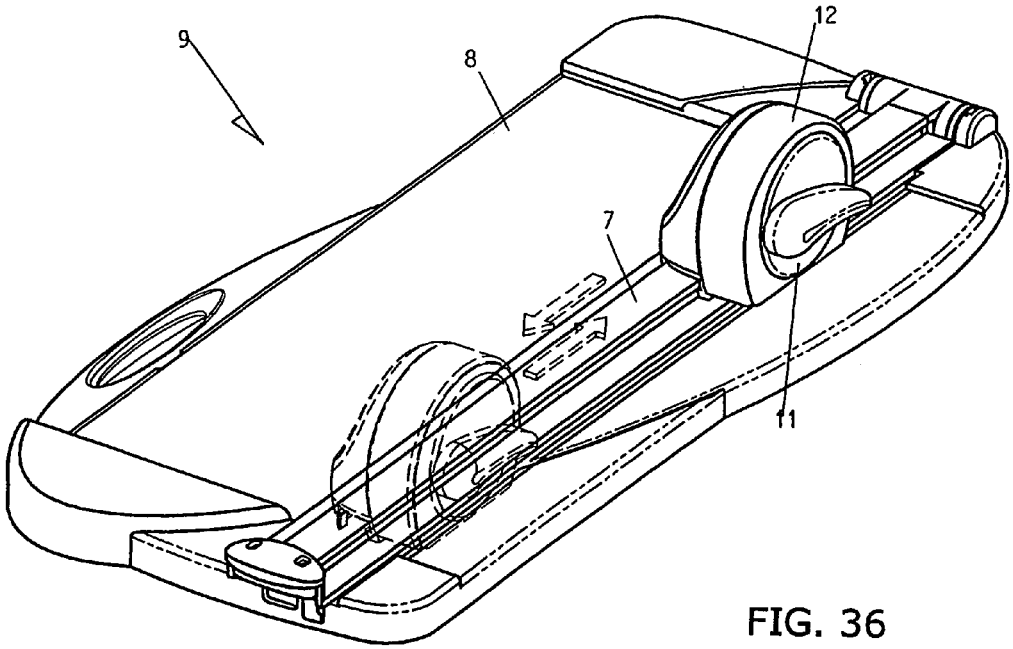
FIG. 36 is a perspective view showing the entire trimmer and how the cutting apparatus is slidable along a rail thereof.

The carriage 12 is in use mounted on a rail 7 of a rotary paper trimmer 9 for carrying the cutting disc 14 to slide along the rail 7 (FIGS. 35 and 36). The construction of the carriage 12 is relatively simple, having an upright generally flat cylindrical body which has an open front side, a bottom opening and an adjacent channel-sectioned base for slidably mounting on the rail 7. The carriage 12 includes, internally on each of its left and right sides, a ramp 20 inclined upwardly from a horizontal plane into the body and a flat lug 19 extending downwardly from the lower outer end of the ramp 20 (FIG. 2). There is also a small central recess 40 at a lower position in the inner surface of the rear wall.

The cassette holder 11 also has an upright generally flat cylindrical body having an open front side and a bottom opening. It is marginally smaller for slotting into the carriage 12, with their front sides facing each other (FIG. 2), closing upon each other to form a cavity locating the cassette 10 for cutting a paper sheet, for example, placed on a board 8 of the paper trimmer 9. The cassette holder body has an equivalent small central recess 40 which is aligned with that of the carriage body.

Figure 3:
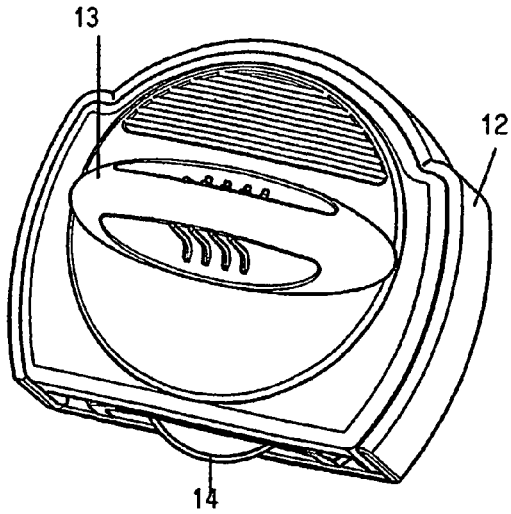
FIG. 3 is a front perspective view similar to FIG. 2, showing the cassette holder with cassette engaged within the carriage.

The cassette 10 is held within the cassette holder 11 (FIG. 1) before the latter is engaged into the carriage 12 (FIG. 3). The cassette 10 is co-operable with the carriage 12 when held by the cassette holder 11 to expose a bottom cutting edge of the cutting disc 14 during closing engagement of the cassette holder 11 with the carriage 12.

A two-part outer cover 28/29 of the cassette 10 protects the entire cutting disc 14. The cover 28/29 is slidable upwardly relative to the cutting disc 14 in a direction parallel to the disc 14, and it is normally, when the cassette 10 is not in use, resiliently biased downwardly to conceal and protect the cutting edge for safety reasons. The cover 28/29 is formed by a pair of first and second plastic cover panels 28 and 29 which cover opposite sides of the cutting disc 14 respectively and are individually slidable.

The cassette 10 includes a pair of first and second support plates 32 and 30 supporting the cutting disc 14 therebetween, together being sandwiched between the cover panels 28 and 29. In the assembled structure, the first support plate 32 lying against the first cover panel 28, and the second support plate 30 against the second cover panel 29.

The support plates 32 and 30 have aligned holes locating a plastic bushing 44, through which the axle 16 extends. Opposite ends of the bushing 44 reach into the cover panels 28 and 29, through respective vertical guiding slots 48 thereof. Opposite ends of the axle 16 project out of the bushing 44 through the cover panels 28 and 29 in opposite directions, for engagement with and hence support by the aligned lower central recesses 40 of the carriage 12 and the cassette holder 11 when the cassette 10 is held by the cassette holder 11 and the cassette holder 11 engages within the carriage 12.

Apart from a planar gap accommodating the cutting disc 14, the support plates 32 and 30 are attached tight together. Each of the two opposite outer surfaces of the support plate assembly 32/30 has four integrally formed pins 41. These pins 41 extend through respective vertical guiding slots 42 of the adjacent first/second cover panel 28/29 and then holes of an outermost metal retaining plate 27 lying on the cover panel 28/29, whose tips are melted onto the plate 27, whereby the two cover panels 28 and 29 are fastened together yet individually slidable relative to the support plates 32 and 30 and the cutting disc 14 in the middle (and also the retaining plates 27).

The second support plate 30 has a pair of opposed upwardly-extending left and right prongs 49 which are resiliently bendable to a limited extent and whose tips are thickened to form respective hooked ends.

The first support plate 32 has a pair of oblong frames lying vertically side-by-side between the prongs 49, in which respective compression coil springs 33 are located. This support plate 32 includes a pair of left and right shoulders, each being two laterally-projecting lugs spaced apart by a horizontal gap (the upper lug being designated by reference numeral 25), in which a respective L-shaped release member 26 is slidably located.

Each of the cover panels 28 and 29 has, on its inner surface, a lug 43 which projects into the bottom end of a respective said frame and is acted upon, from above, by the corresponding spring 33 such that the cover panel 28/29 is resiliently biased to slide downwardly relative to the cutting disc 14, thereby concealing the bottom cutting edge thereof (FIGS. 27 to 32).

The first cover panel 28 has, at an upper position, a pair of left and right ears 18 projecting laterally outwardly in opposite directions. The ears 18 are mutually aligned and are aligned with the ramps 20 of the carriage 12.

Figure 14:
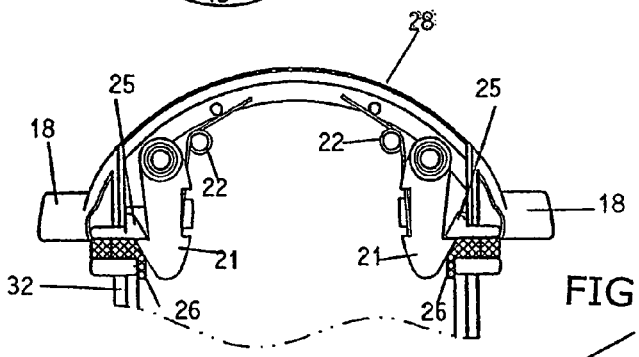
FIG. 14 is a fragmentary internal view of the cassette and cassette holder of FIG. 13, showing a pair of latches.

The first cover panel 28 includes, on the left and right sides of its inner surface, a pair of resilient latches in the form of two hinged pawls 21, each being resiliently biased by a respective elbow spring 22 to pivot outwardly into engagement with the corresponding shoulder lug 25 of the adjacent first support plate 32 on the same side. The pawls 21 engage with the corresponding shoulder lugs 25 from below (FIG. 14), thereby latching to block against upward movement of the cover panel 28 relative to the support plate 32 and hence the cutting disc 14 (whose bottom cutting edge therefore remains concealed).

Figure 15:
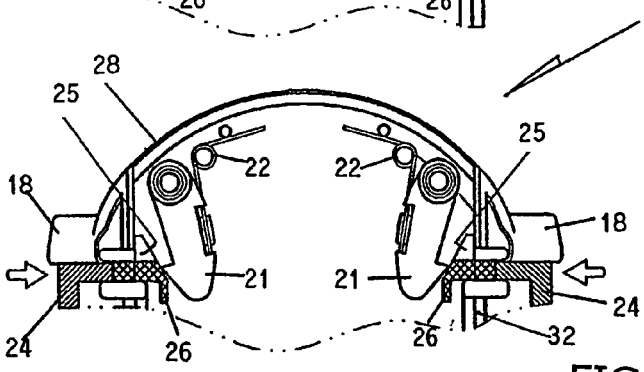
FIG. 15 is a fragmentary internal view similar to FIG. 14, showing the latches being released.
Figure 16:
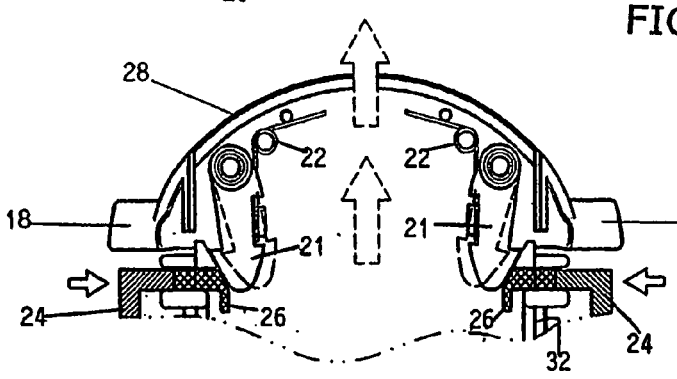
FIG. 16 is a fragmentary internal view similar to FIG. 15, showing the latches released to permit lifting of a first cover of the cassette.

Each of the latching pawls 21 may be released by the release member 26 that is located immediately below the corresponding shoulder lug 25, when the release member 26 is pushed inwardly (by a pin 24 of the cassette holder 11) to pivot and disengage the pawl 21 from the shoulder lug 25 (FIG. 15), whereupon the first cover panel 28 is unlocked and may be slid upwards (FIG. 16) to expose the bottom cutting edge of the cutting disc 14.

Figure 20:
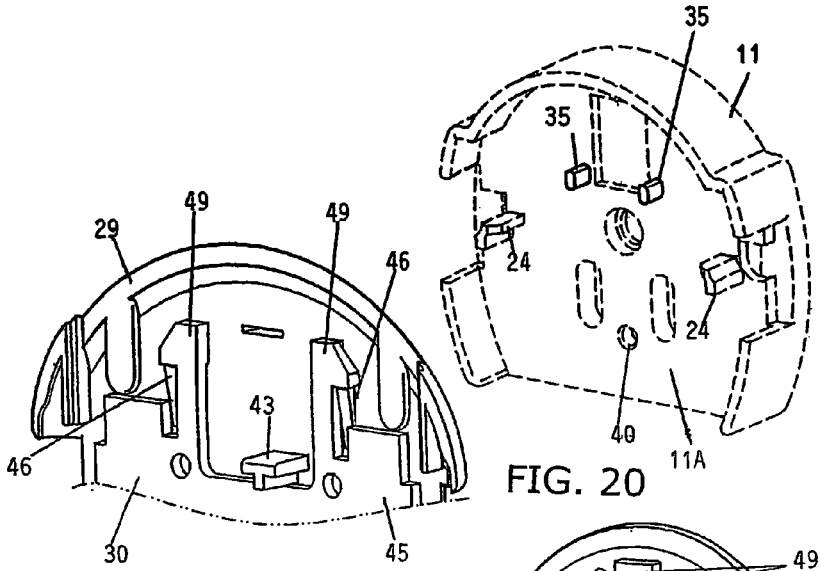
FIG. 20 is a rear perspective view of certain parts of the cassette and cassette holder of FIG. 13.
Figure 21:
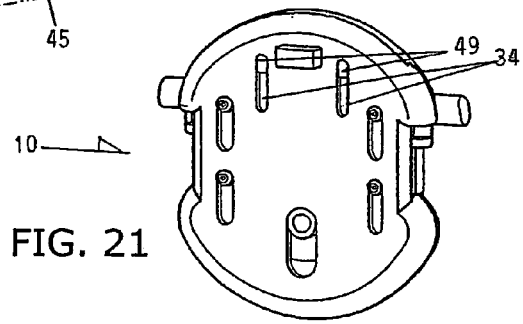
FIG. 21 is a perspective view showing the opposite side of the cassette of FIG. 20.

The second cover panel 29 has, on the left and right sides of its inner surface, a pair of upwardly-inclined ramps 46 in engagement by the hooked ends of the respective prongs 49 of the second support plate 30 on the corresponding sides. The hooked ends engage with the corresponding ramps 46 from above (FIG. 20), thereby latching to block against upward movement of the cover panel 29 relative to the support plate 30 and hence the cutting disc 14 (whose bottom cutting edge therefore remains concealed).

Figures 22, 23, 24:
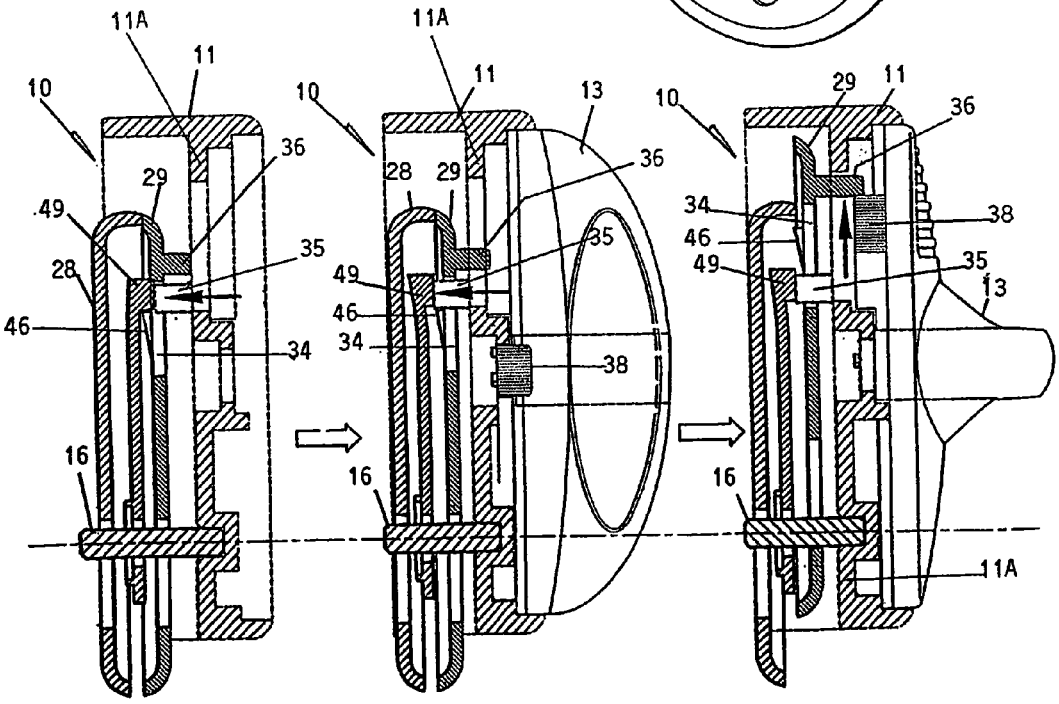
FIG. 22 is a cross-sectional side view of the cassette held in the cassette holder of FIG. 20, showing a latch.
FIG. 23 is a cross-sectional side view similar to FIG. 22, showing the latch being released.
FIG. 24 is a cross-sectional side view similar to FIG. 23, showing the latch released to permit lifting of a second cover of the cassette.

There is a vertical slot 34 in the second cover panel 29 right behind each of the prongs 49, through which slot 34 the prong 49 may be pushed and deflected inwardly (by a pin 35 of the cassette holder 11) against its own resilience to disengage its hooked end from the corresponding ramp 46 (FIGS. 22 and 23), whereupon the latching prong 49 is released and the second cover panel 29 is unlocked and may be slid upwards (FIG. 24) to expose the bottom cutting edge of the cutting disc 14.

Figure 4:
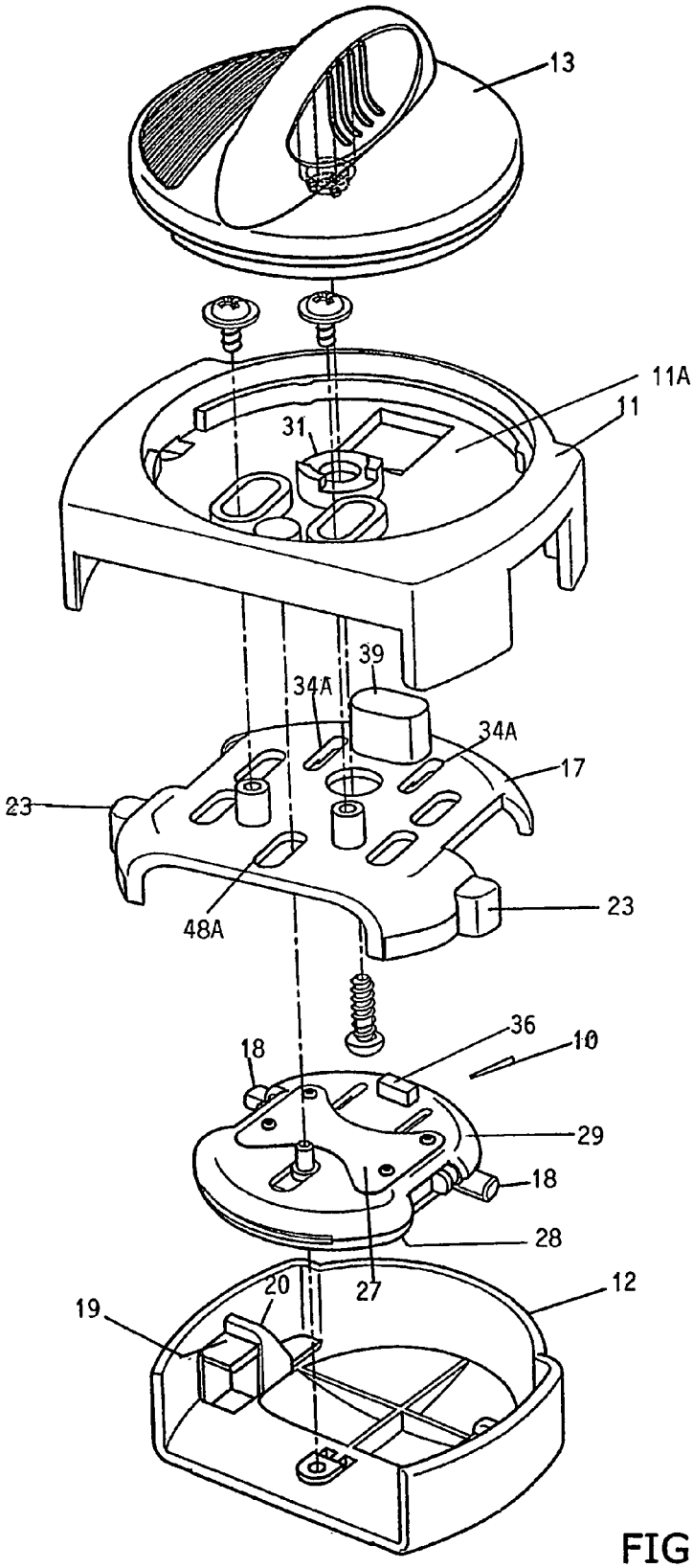
FIG. 4 is a perspective view of the cutting apparatus of FIG. 3, with its components in separation.
Figure 6:
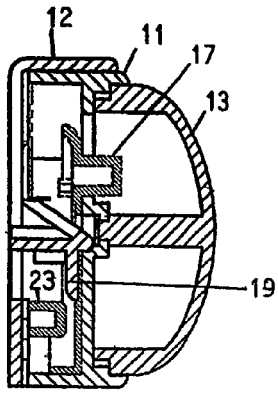
FIG. 6 is a cross-sectional view of the cutting apparatus of FIG. 5, taken along line VI-VI.
Figure 5:
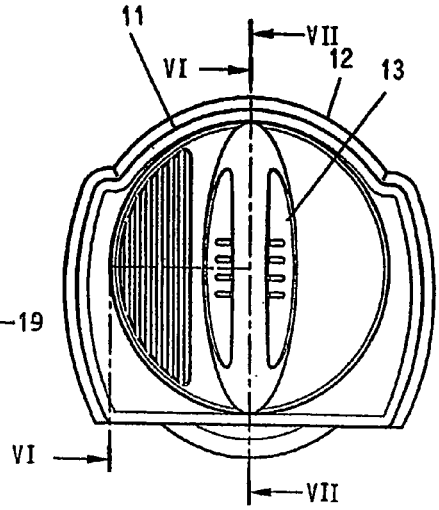
FIG. 5 is a front view of the cutting apparatus of FIG. 3, in an inoperative condition.
Figure 7:
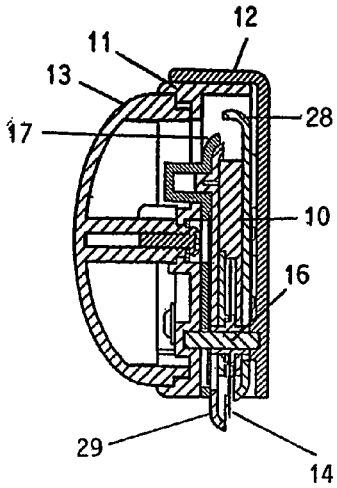
FIG. 7 is a cross-sectional view of the cutting apparatus of FIG. 5, taken along line VII-VII.
Figure 9:
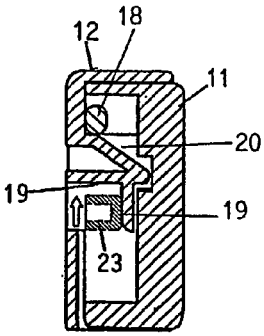
FIG. 9 is a cross-sectional view of the cutting apparatus of FIG. 8, taken along line IX-IX.
Figure 8:
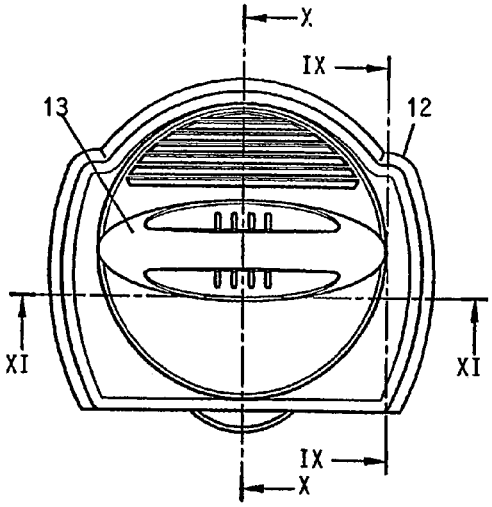
FIG. 8 is a front view of the cutting apparatus of FIG. 3, in an operative condition.
Figure 10:
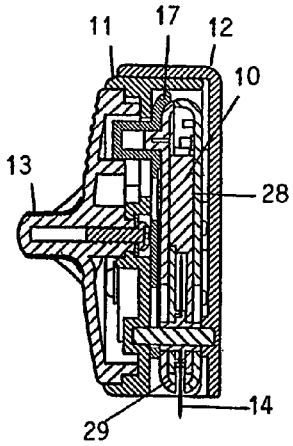
FIG. 10 is a cross-sectional view of the cutting apparatus of FIG. 8, taken along line X-X.
Figure 11:
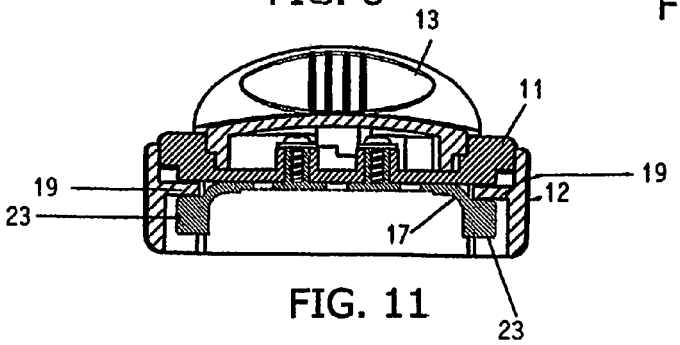
FIG. 11 is a cross-sectional view of the cutting apparatus of FIG. 8, taken along line XI-XI.
Figure 12:
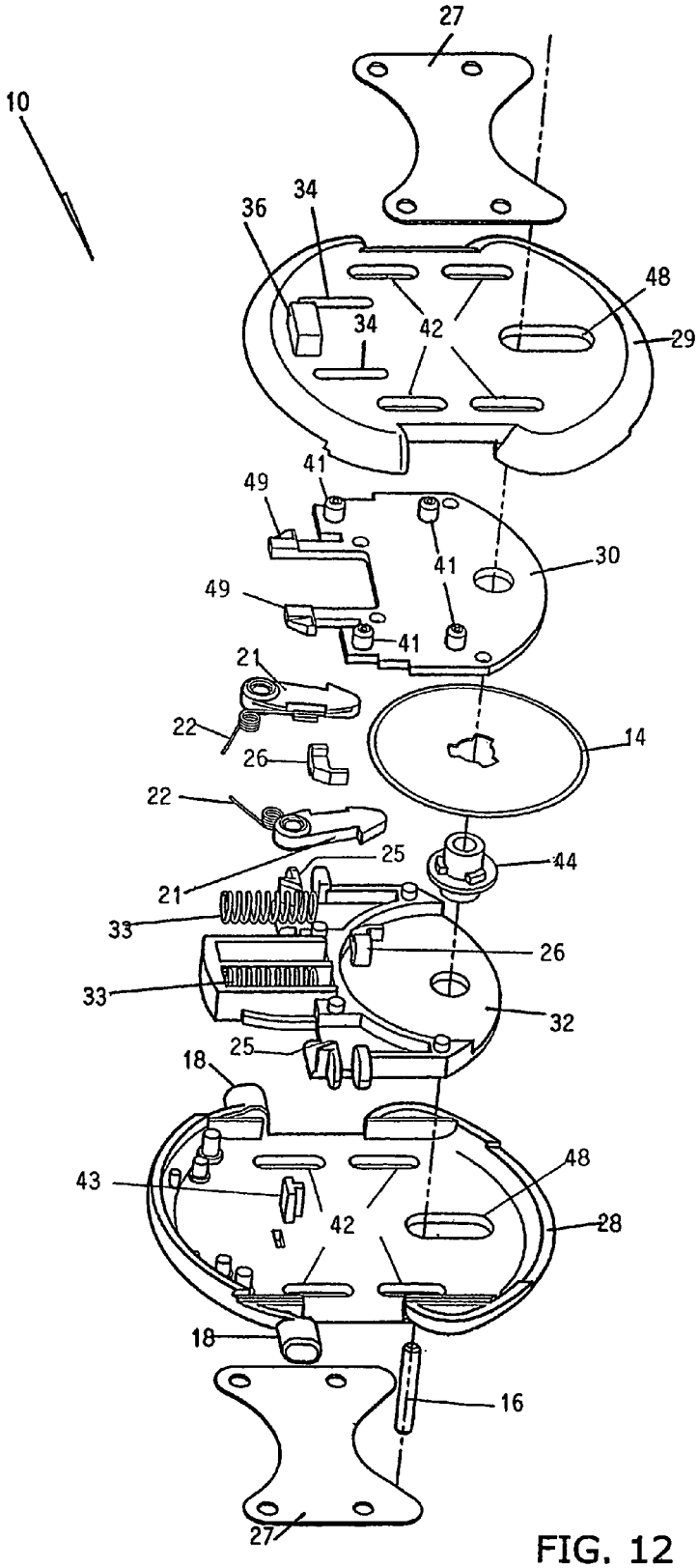
FIG. 12 is an exploded perspective view of the cutter cassette of FIG. 1.

Returning to the cassette holder 11, it incorporates a manual operator in the form of a turning knob 13 provided on a rear wall 11A of its body for moving the second cover panel 29. The knob 13 is fastened by a central screw onto the cassette holder body, for turning about the screw through an angle that is limited to 90° by a central collar 31 on the rear wall 11A through which the screw extends (FIG. 4). The knob 13 has a cam 38 on its inner surface, at an eccentric position thereof, for sliding the second cover panel 29 upwards. The cam 38 is restricted by the collar 31 to turn through an angle of only 90° (FIGS. 25 and 26).

The cassette holder 11 includes a cradle 17 for holding and retaining the cassette 10 by its second cover panel 29 facing the cradle 17, which is shaped to match and fit the cover panel 29. The cradle 17 is attached onto the inner surface of the rear wall 11A of the cassette holder body, opposite the turning knob 13, by means of two screws which extend through respective vertical slots of the rear wall 11A such that the cradle 17 is slidable upwardly and downwardly (FIG. 4). Although this is not shown in the drawings, the cradle 17 is resiliently biased by a hidden spring to slide downwards.

Figure 25:
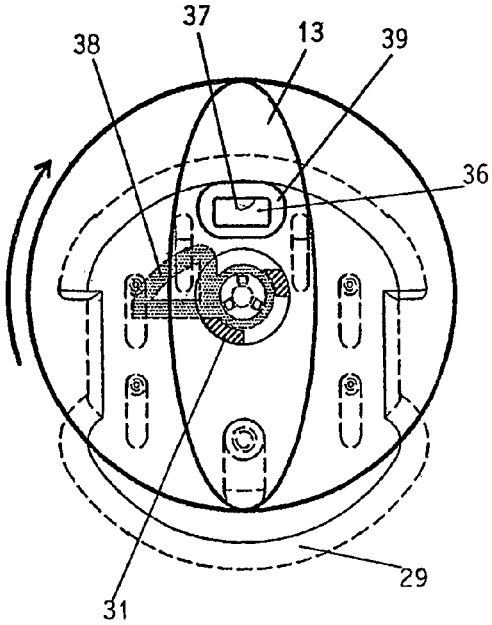
FIG. 25 is an internal front view of the cassette holder with cassette of FIG. 23.
Figure 26:
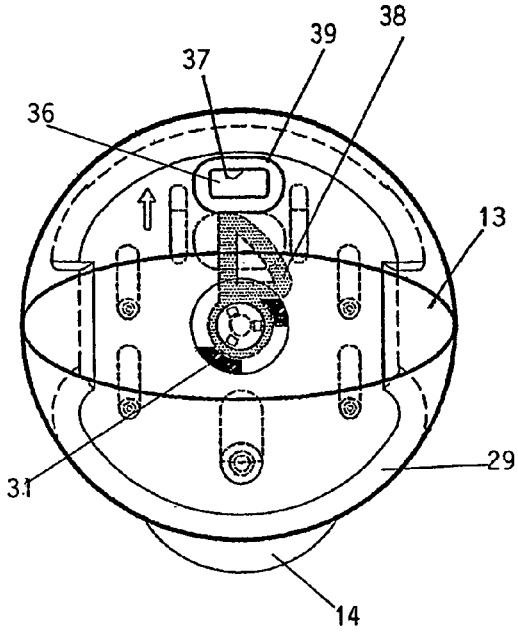
FIG. 26 is an internal front view similar to FIG. 25, showing the cassette holder with cassette of FIG. 24 and how the second cover is lifted.
Figure 27:
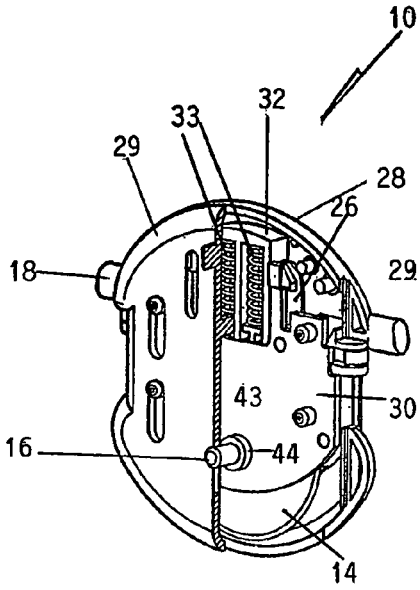
FIG. 27 is a perspective view of the cassette of FIGS. 18 and 26, showing the first and second covers being spring-loaded downwards.
Figure 28:
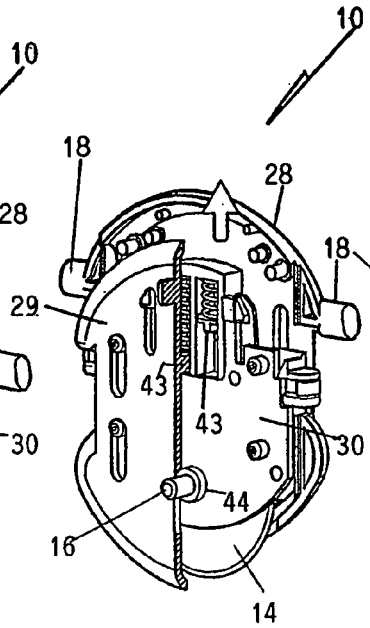
FIG. 28 is a perspective view similar to FIG. 27, showing lifting of the first cover against its associated spring.
Figure 29:
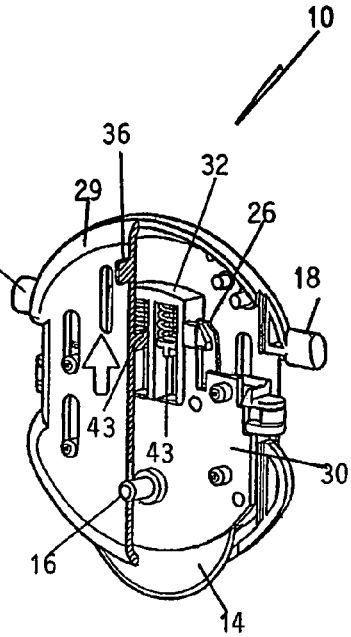
FIG. 29 is a perspective view similar to FIG. 28, showing also lifting of the second cover against its associated spring.
Figure 30:
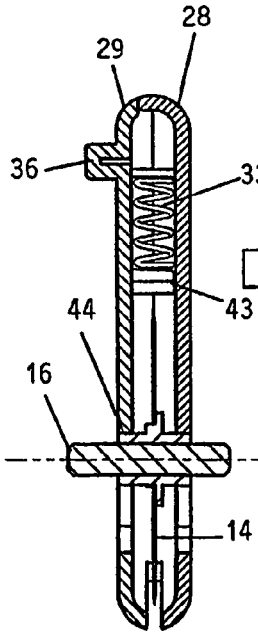
FIG. 30 is a cross-sectional side view of the cassette of FIG. 27.
Figure 31:
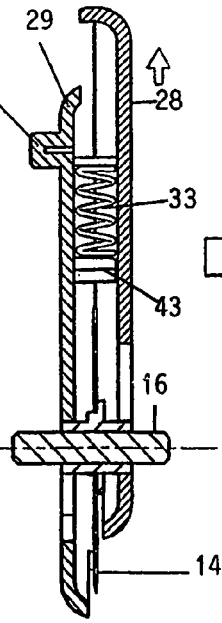
FIG. 31 is a cross-sectional side view of the cassette of FIG. 28.
Figure 32:
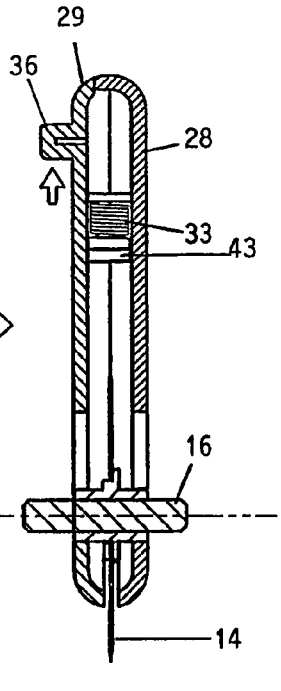
FIG. 32 is a cross-sectional side view of the cassette of FIG. 29.
Figure 33:
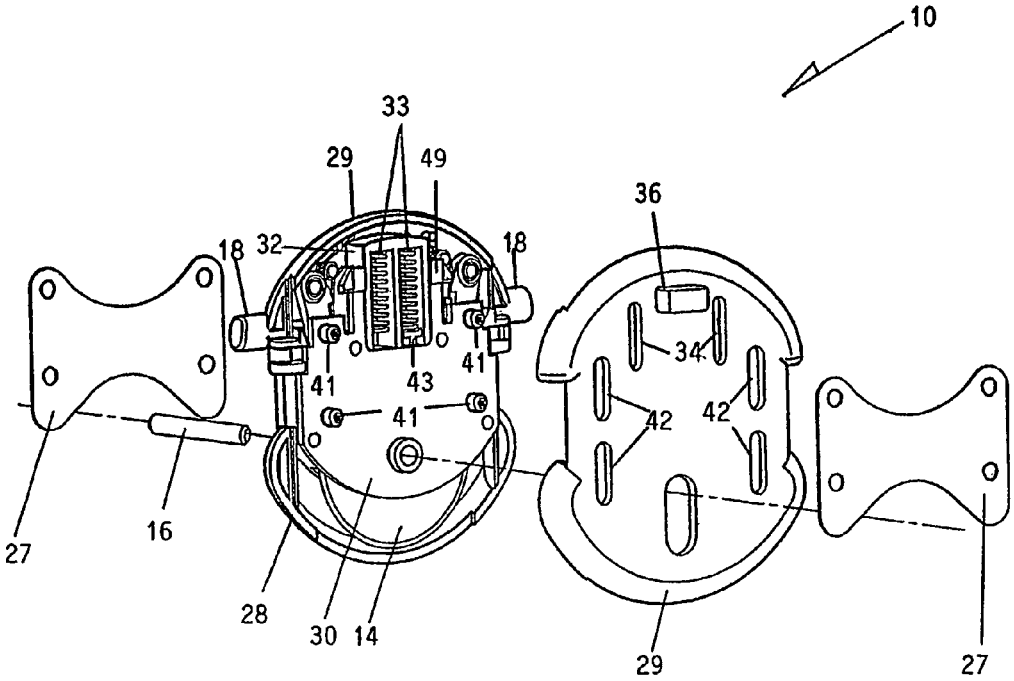
FIG. 33 is a part-exploded perspective view of the cassette of FIG. 27.

The cradle 17 has a pair of left and right ears 23 and includes centrally an upper rear protrusion 39 which extends through the rear wall 11A and acts as a cam follower for engagement by the cam 38 of the turning knob 13 to slide upwards, carrying with it the cassette' second cover panel 29 (FIGS. 25 and 26). The protrusion 39 is hollow and forms a recess 37 on the front side of the cradle 17 for engagement by a matching protrusion 36 of the second cover panel 29 to ensure that the cover panel 29 slides with the cradle 17. It is noted that the cam 38 of the turning knob 13 engages, indirectly via the protrusion 39, the second cover panel 29 to move the cover panel 29.

Figure 13:
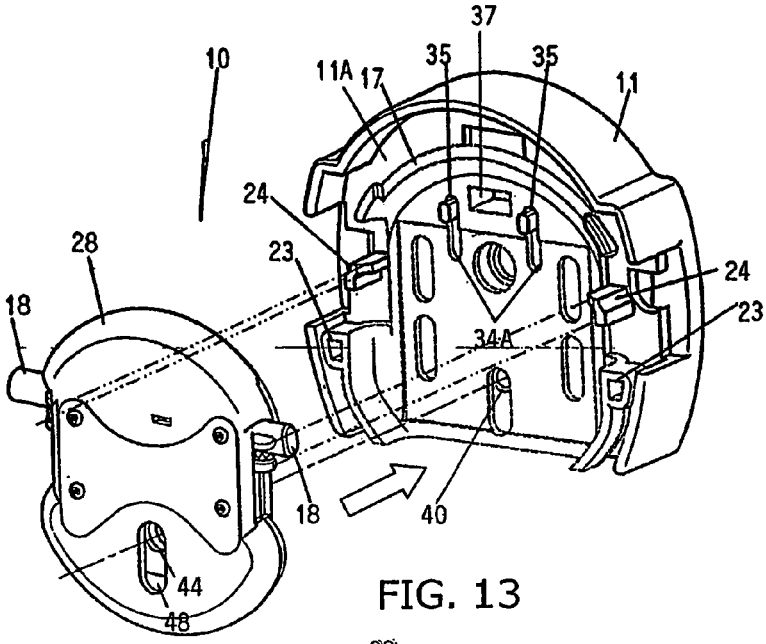
FIG. 13 is a rear perspective view of the cassette and cassette holder of FIG. 1, prior to engagement.

The cradle 17 further includes a pair of vertical slots 34A which are aligned with the two slots 34 of the second cassette cover panel 29 when the cassette 10 is held in the cradle 17. A pair of flat pins 35 extends integrally from the rear wall 11A of the cassette holder 11 forward through the slots 34A respectively (FIG. 13). The pins 35 are aligned with and are used to release the latching prongs 49 as described above (FIGS. 22 and 23).

Also projecting from the rear wall 11A is a pair of L-sectioned pins 24 which extend forward past left and right sides of the cradle 17, above the ears 23 of the cradle 17. These pins 24 are aligned with and are used to push in the release member 26 to release the latching pawls 21 as described above (FIG. 15).

Prior to use of the cassette 10, both of its cover panels 28 and 29 extend lowermost, under the action of the internal springs 33, to conceal and protect the bottom cutting edge of the cutting disc 14 for safety reasons. The first and second cover panels 28 and 29 are locked in the lowermost position by the latching pawls 21 and prongs 49 respectively.

For use, the cassette 10 is located in the cassette holder 11 before the latter is engaged within the carriage 12. The cassette 10 should be placed into the cradle 17 (inside the cassette holder 11) in a direction with the forward end of the cutting disc axle 16 aligned with the recess 40 of the cassette holder 11, for engaging the recess 40. When the cassette 10 is being placed into the cradle 17 (FIG. 13), upon engaging the holder's pins 24 and 35, its first and second cover panels 28 and 29 are unlocked simultaneously as described above (FIGS. 15 and 23).

Figure 17:
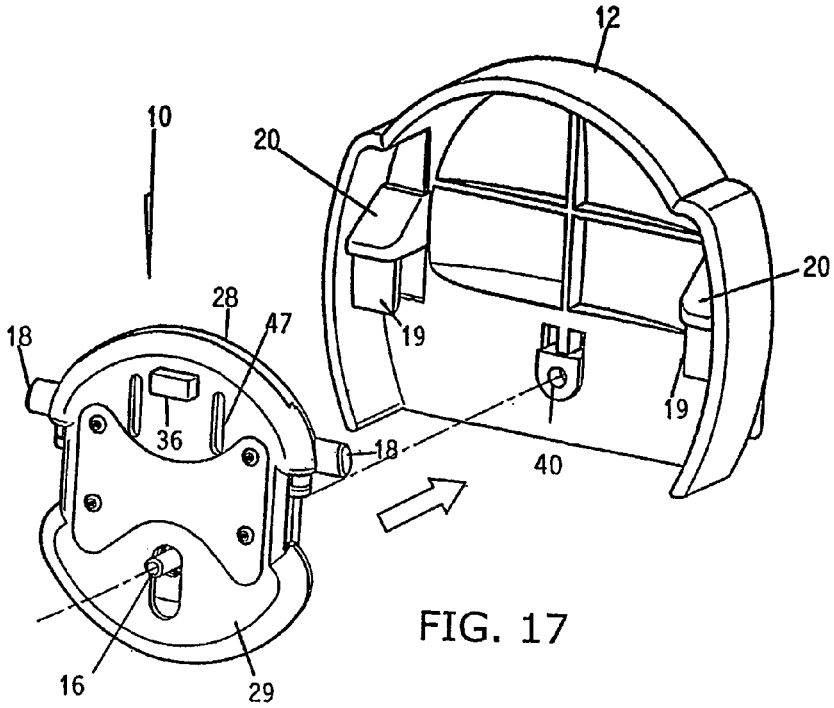
FIG. 17 is a front perspective view of the cassette and carriage of FIGS. 1 and 2, prior to engagement.
Figure 18:
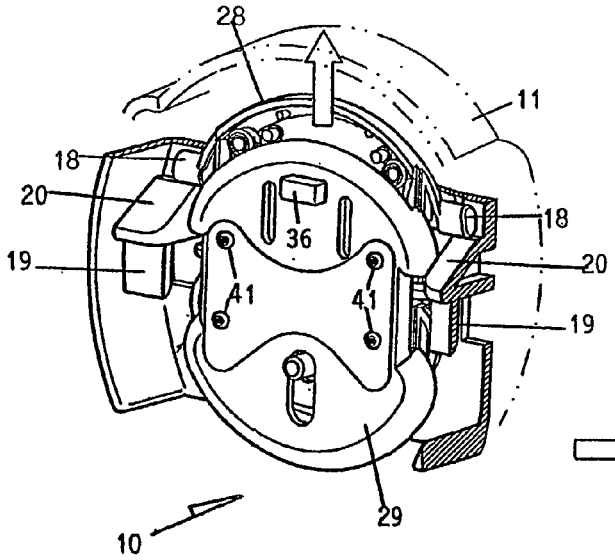
FIG. 18 is a front perspective view similar to FIG. 17, showing the components engaged and how the first cover is lifted.
Figure 19:
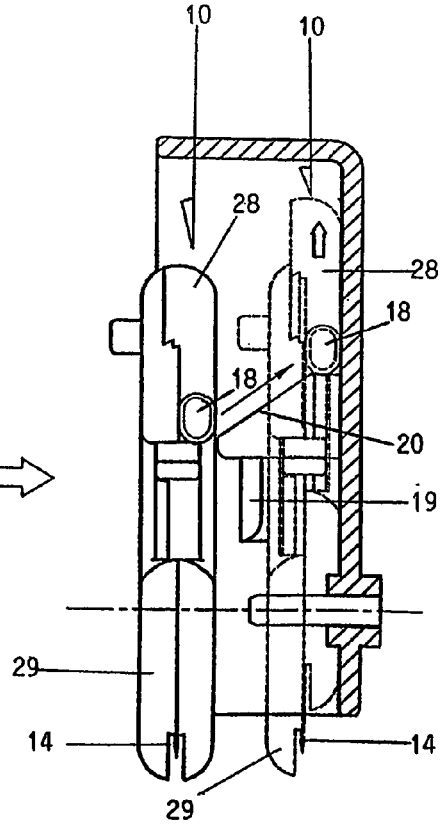
FIG. 19 is a side view corresponding to FIG. 18.

The cassette holder 11 with the cassette 10 should be inserted into the carriage 12 in a horizontal direction with the other end of the cutting disc axle 16 aligned with the recess 40 of the carriage 12, for engaging the recess 40. As the cassette holder 11 is being inserted into and closing the carriage 12, the ears 18 of the first cover panel 28 engage upon and ride upwardly along the corresponding ramps 20 of the carriage 12, whereby the cover panel 28 is slid upwardly to expose the corresponding side of the bottom cutting edge of the cutting disc 14 (FIGS. 17 to 19).

After the cassette holder 11 with the cassette 10 has been closed into and engaged within the carriage 12, the axle 16 supporting the cutting disc 14 is fixed. The operating knob 13 is then turned clockwise to raise the cradle 17 inside to thereby also slide the second cover panel 29 upwardly to expose the remaining side of the cutting edge of the cutting disc 14 (FIGS. 25 and 26). As the cradle 17 is lifted, its ears 23 slide into engagement behind the corresponding lugs 19, whereby the cassette holder 11 is retained and interlocks with the carriage 12, and the cassette 10 is firmly held inside.

Figure 34:
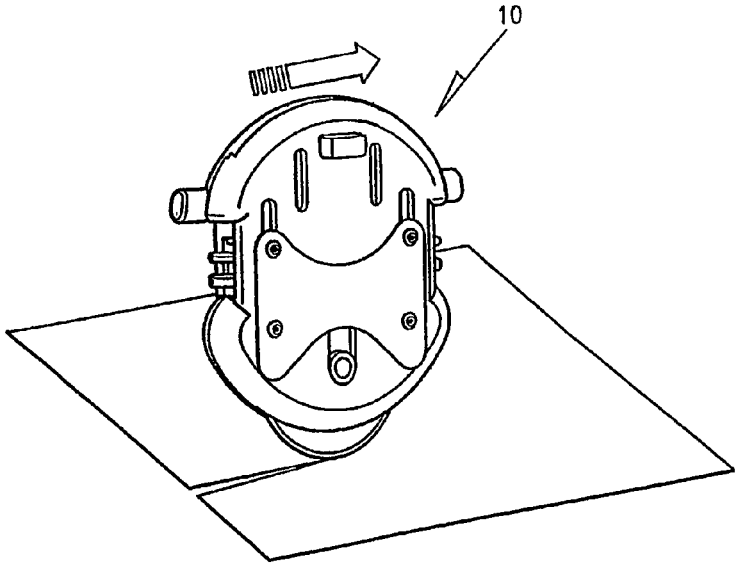
FIG. 34 is a perspective view showing the cassette cutting a sheet of paper.

The bottom cutting edge of the cutting disc 14 is now uncovered on both sides and can then be used to cut a paper sheet (FIG. 34) on the board 8 by sliding the carriage 12 along the rail 7 of the paper trimmer 9 (FIG. 36).

Cassettes 10 incorporating cutting discs 14 which have different cutting edges for cutting in different patterns, such as wavy, zigzag and partial cuts (i.e. other than a continuous straight cut), are available for selective interchangeable use, as desired.

To remove the cassette 10 for replacement with another one, the knob 13 is turned anti-clockwise to release the cassette holder 11 from the carriage 12 through disengagement of the cradle ears 23 from the carriage tabs 19. In doing so, the second cover panel 29 is allowed to return simultaneously (with the knob cam 38) under the action of the corresponding spring 33. Upon detachment of the cassette holder 11 from the carriage 12, the cassette ears 18 depart from the carriage ramps 20, whereby the first cover panel 28 is allowed to return instantly by the other spring 33.

The cassette 10 may then be removed from the cassette holder cradle 17 for placing of another cassette 10. As soon as the cassette 10 detaches from the cradle 17, its four latches 21 and 49 are released from the cassette holder pins 24 and 35 and hence they instantly re-engage and lock the two cover panels 28 and 29. Both cover panels 28 and 29 are now locked safe to conceal and protect the bottom cutting edge of the cutting disc 14.

The present invention provides a very safe replacement cutter cassette (or cartridge), in which the blade cover 28/29 cannot readily be opened to expose the cutting edge, unless the cassette 10 is both installed upon the cassette holder 11 and the cassette holder 11 is in turn installed upon the carriage 12, and the knob 13 turned. Upon insertion of the cassette holder 11 into the carriage 12, the first cover part 28 is automatically slid to expose one side of the cutting edge. Upon turning of the knob 13, the second cover part 29 is also automatically slid to expose the other side of the cutting edge, and the cassette holder 11 is thereby retained in the carriage 12. No direct user action upon the blade cover 28/29 is needed.

It is envisaged that the cassette holder 11 may be provided as part of the carriage 12. For example, the cassette holder 11 may be pivotably connected to the carriage 12 like a hinged lid, into which lid a cutter cassette may be dropped, and the lid is then closed to mount the cassette in an operative position.

The invention has been given by way of example only, and various modifications of and/or alterations to the described embodiment may be made by persons skilled in the art without departing from the scope of the invention as specified in the appended claims.

The invention claimed is:

1. A cutting apparatus for cutting sheets, the cutting apparatus comprising:

a carriage for sliding along a rail;

a cassette holder engageable with the carriage; and a cassette encasing a cutting blade and co-operable with the carriage, when held by the cassette holder, to expose a cutting edge of the cutting blade during closing engagement of the cassette holder with the carriage, wherein the cassette includes a cover covering the entire cutting blade, the cover is movable relative to the cutting blade and has a cover part engageable with a carriage part of the carriage, upon the engagement, to move the cover and expose the cutting edge of the cutting blade, the cover is slidable relative to the cutting blade in a direction parallel to the cutting blade, the cover comprises first and second cover members covering opposite sides of the cutting blade, the first and second cover members are individually slidable, and the first cover member includes the cover part engageable with the carriage part, upon the engagement, to move the first cover member and thereby expose a corresponding side of the cutting edge of the cutting blade.

2. The cutting apparatus as claimed in claim 1, including an operator on one of the carriage and the cassette holder, and which is arranged to move the second cover member to expose the corresponding side of the cutting edge of the cutting blade, subsequent to the engagement.

3. The cutting apparatus as claimed in claim 2, wherein the operator is located at the cassette holder.

4. The cutting apparatus as claimed in claim 2, wherein the operator has an operator part engageable with a second cover part of the second cover member to move the second cover member, the operator and second cover parts including a cam and a cam follower.

5. The cutting apparatus as claimed in claim 4, wherein the operator part is engageable indirectly with the second cover part, and comprises a cam that turns to move the second cover member.

6. The cutting apparatus as claimed in claim 2, wherein the operator incorporates a retainer and is arranged to move the retainer to interlock with the one of the carriage and the cassette holder on which the operator is not present, thereby retaining the cassette holder on the carriage.

7. The cutting apparatus as claimed in claim 6, wherein the operator is located at the cassette holder, and the retainer engages the second cover member to hold the cassette and move the second cover member.

8. The cutting apparatus as claimed in claim 1, wherein the carriage part comprises a ramp inclined relative to the direction in which the engagement occurs, for engagement with the cover part to move the cover.

9. The cutting apparatus as claimed in claim 1, wherein the cutting blade comprises a rotary cutting disc supported centrally on an axle for rotation about the axle.

10. The cutting apparatus as claimed in claim 9, wherein the carriage and the cassette holder have respective supports for supporting opposite ends of the axle when the cassette is held by the cassette holder and the cassette holder engages the carriage.

11. The cutting apparatus as claimed in claim 1, wherein the cassette includes a support member supporting the cutting blade, and further including a resilient latch located between the support member and the cover, blocking movement of the cover relative to the cutting blade, the latch being releasable by a part of the cassette holder upon the cassette being held by the cassette holder.

12. The cutting apparatus as claimed in claim 11, including a spring resiliently biasing the cover to conceal the cutting edge of the cutting blade, wherein the latch is located at one of the support member and the cover, the latch being re-engageable with an adjacent part of the one of the support member and the cover where the latch is not located.

13. The cutting apparatus as claimed in claim 11, wherein each of the first and second cover members is latched by respective first and second latches against individual movement relative to the cutting blade, and the cassette holder includes first and second parts for releasing the first and second latches, respectively.

14. A cutting cassette for use in a rotary paper trimmer having a carriage for carrying the cassette to move along a path, the cassette comprising:

a rotary cutting blade; and a cover covering the cutting blade, wherein the cassette is co-operable with the carriage to expose a cutting edge of the cutting blade during engagement of the cassette with the carriage, the cover encases the entire cutting blade and is movable relative to the cutting blade, the cover has a cover part engageable with a carriage part of the carriage, upon the engagement, to move the carriage and expose the cutting edge of the cutting blade, the cover is slidable relative to the cutting blade in a direction parallel to the cutting blade, the cover comprises first and second cover member covering opposite sides of the cutting blade, the first and second cover members are individually slidable, and the first cover member includes the cover part engageable with the carriage part, upon the engagement, to move the first cover member and thereby expose a corresponding side of the cutting edge of the cutting blade.

15. The cutting cassette as claimed in claim 14, wherein the second cover member has a cam follower for movement by a cam at the carriage to expose the corresponding side of the cutting edge of the cutting blade, subsequent to the engagement.

16. The cutting cassette as claimed in claim 14, including a support member supporting the cutting blade, and further including a resilient latch located between the support member and the cover, blocking movement of the cover relative to the cutting blade, the latch being releasable by a part of a cassette holder co-operable with the carriage, upon the cassette being held by the cassette holder.

17. The cutting cassette as claimed in claim 16, including a spring resiliently biasing the cover to conceal the cutting edge of the cutting blade, wherein the latch is located at one of the support member and the cover, the latch being re-engageable with an adjacent part of the one of the support member and the cover where the latch is not located.

18. The cutting cassette as claimed in claim 14, wherein each of the first and second cover members is latched by a first latch and a second latch, respectively, against individual movement relative to the cutting blade, the first and second latches being releasable by respective first and second parts of the cassette holder.

19. The cutting cassette as claimed in claim 18, wherein the first latch for the first cover member is a resiliently biased latch located at the first cover member.

20. The cutting cassette as claimed in claim 18, wherein the second latch for the second cover member is a resiliently deformable latch located at the support member.

* * * * *